United States Patent [19]

Rich, Jr.

[11] 4,214,408

[45] Jul. 29, 1980

[54] MONOLITHIC ROOM ENCLOSING MODULE AND METHOD OF FORMING THE SAME

[75] Inventor: Frank D. Rich, Jr., Darien, Conn.

[73] Assignee: F. D. Rich Housing Corp., Stamford, Conn.

[21] Appl. No.: 903,906

[22] Filed: May 8, 1978

[51] Int. Cl.[2] ..... E04B 2/64

[52] U.S. Cl. ..... 52/79.1; 52/91; 52/252; 52/443; 52/302; 52/443; 52/747

[58] Field of Search ..... 52/91, 741, 747, 251, 52/443, 444, 79.1, 95, 302, 303, 252; 264/35

[56] References Cited

U.S. PATENT DOCUMENTS

| | | | |
|---|---|---|---|
| 1,350,656 | 8/1920 | King | 52/444 |
| 1,532,874 | 4/1925 | Broady | 52/444 |
| 1,795,338 | 3/1931 | Knipe | 52/747 |
| 2,835,126 | 5/1958 | Paolella | 52/444 |
| 2,855,869 | 10/1958 | Monters | 52/303 |
| 3,323,266 | 6/1967 | Dalkas | 52/22 |
| 3,475,873 | 11/1969 | Steadman | 52/444 |

FOREIGN PATENT DOCUMENTS

| | | | |
|---|---|---|---|
| 802588 | 1/1951 | Fed. Rep. of Germany | 52/22 |
| 255597 | 7/1927 | Italy | 52/91 |
| 111784 | 5/1962 | Pakistan | 52/747 |

*Primary Examiner*—John E. Murtagh
*Attorney, Agent, or Firm*—Haynes N. Johnson

[57] ABSTRACT

In a method for forming a module having a floor, a roof and opposing sides, a concrete floor is first poured and, once solidified, moved into position between tilted wall molds. Inexpensive hollow masonry blocks are then dry-stacked in rows against the wall molds; that is, they are loosely stacked without mortar therebetween. Spaces with reinforcing rods therein are left along the outer wall molds at each end of the stacked blocks. Inner wall molds and, for some modules, a roof mold are then moved into place adjacent the stacked blocks. With the wall molds vertical, the blocks are pressed between the inner and outer wall molds. Concrete is poured into the spaces at each end of the stacks of blocks to form structural posts and over the tops of the stacks of blocks to form structural spandrel beams. Additional hollow blocks are laid across the roof mold and concrete is poured over those blocks to complete the roof. Once the concrete has cured, the outer wall molds are tilted away, and the molded structure is moved to another station. At the second station, the inner molds are removed and the blocks, held in compression by the weight of the spandrel, are coated with stucco to bind the blocks to each other. End walls are also constructed at this station.

The resulting module includes a roof primarily supported by structural posts and spandrel beams. Stacked blocks forming the walls of the module are in compression to assure sufficient friction between the blocks for structural stability of the walls. Structural stability of the blocks is enhanced by the cementitious stucco coating.

20 Claims, 26 Drawing Figures

A
B
C 51
52
53
54
56
58
60
64
66
68
70
72
74
76
78
80
82
83
94
96
98
100
102
104
106
108
110
112
114
115
116
118
120
122
124
126
128
130
132

Fig. 13.
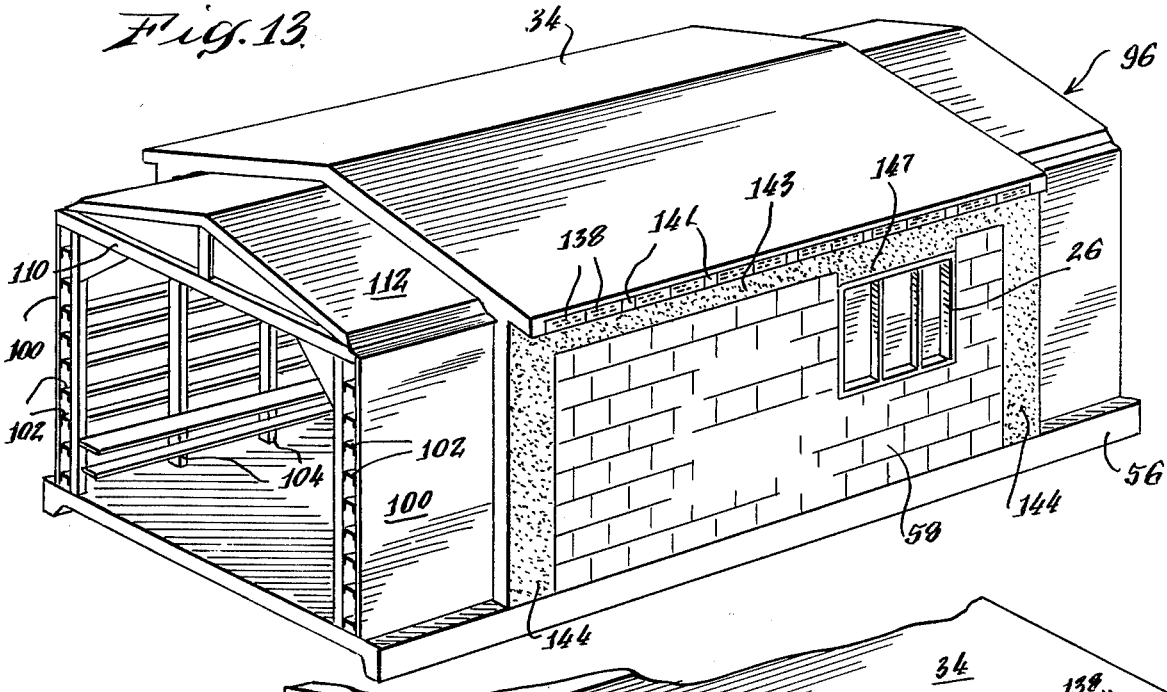
Fig. 16.
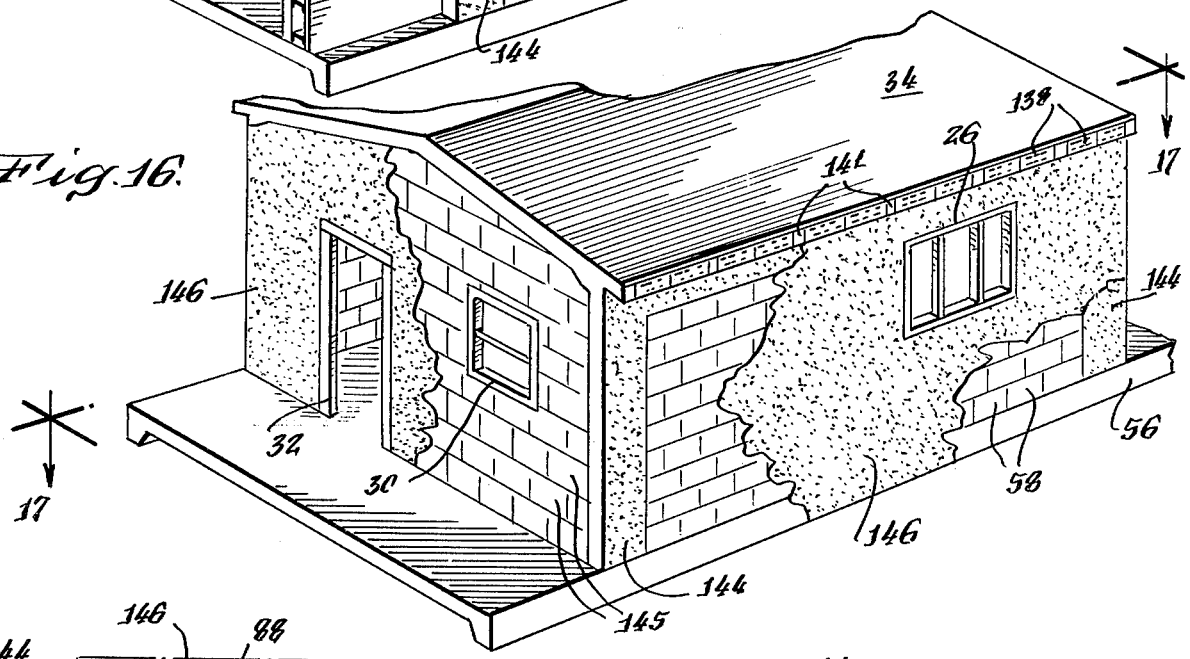
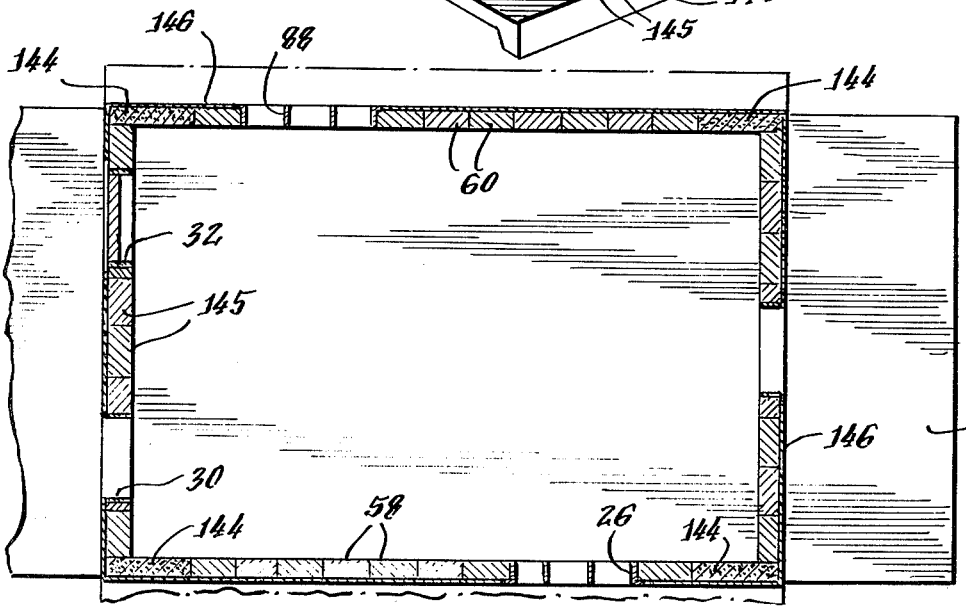
Fig. 17.

MONOLITHIC ROOM ENCLOSING MODULE AND METHOD OF FORMING THE SAME

BACKGROUND OF THE INVENTION

This invention relates to monolithic room enclosing modules and particularly to an inexpensive method for making such modules.

In recent years, prefabricated room-enclosing boxes or modules have found wide acceptance an an alternative construction technique. Such modules are generally formed by pouring concrete into a mold at a factory. The completed module is then transported to the construction site where it may be used alone as a single-room building or in conjunction with identical modules to form multiroom buildings, including high-rise buildings.

In many areas of the world the concrete which is used in both conventional and prefabricated building techniques is expensive. To reduce the amount of concrete required in conventional techniques, and to thus reduce the cost of the building, filler blocks such as hollow clay tiles are often used.

In conventional reinforced concrete structures which do not use prefabricated modules, a skeleton of vertical structural posts, horizontal beams and floors is formed by pouring concrete into molds at the construction site. Often, in-fill cinder blocks or hollow clay tile are stacked between the structural posts and held together with mortar to form the building walls. These walls may then be coated with stucco or other finishing material. Of course, such a building technique does not provide the many advantages of prefabricated, factory-constructed module techniques. Further, placing the in-fill blocks in the structure can be very time consuming and costly. As an alternative, in-fill masonry blocks are not set in mortar, and are held in place only by the stucco skin. But this technique is less likely to provide the structural stability required to withstand high lateral forces.

An object of this invention is to provide a room-enclosing module which uses no more concrete, or less concrete, than is necessary with conventional building techniques but which still retains the advantages of low-labor concrete molding of room-sized molds. Further, an object of this invention is to provide a method for molding a module in which the walls of the module are held together by more than just a stucco skin in order that the walls will withstand exceptionally high lateral forces, but which does not require that filler blocks be individually mortared together.

SUMMARY

In accordance with the method of the present invention, rows of filler blocks or hollow tiles are dry-stacked without mortar on a module base or floor to form the major portions of two opposed module walls. The stacks of blocks are then pressed between inner and outer wall molds and a plastic structural material such as concrete is poured to form structural posts at each end of the stacks of tiles. The concrete is also poured over the blocks to form a spandrel beam, and it is poured across a roof support to form a structural roof spanning the floor. With the weight of the spandrel beam on the filler blocks as well as on the structural posts, the blocks are held together in compression to increase the friction therebetween. The mold is then removed and the walls are coated with a cementitious material, such as stucco. The filler blocks in the completed module are held together by both compressive friction and the cementitious skin.

The filler blocks are stacked on the floor against outer wall molds. Then an inner mold is positioned between the walls of stacked blocks and inner wall molds press the blocks against the outer wall molds. The inner mold and outer wall molds are removed only after the concrete has been poured and has cured.

A pitched roof may also be formed using filler blocks. These would span between the walls of stacked blocks and be covered with poured concrete. If the through holes in the roof blocks are aligned and open to the atmosphere, they form air convection channels from the eaves of the module to the highest point of the pitched roof; and natural cooling convection is induced when the roof is heated by the sun. The convected air thus carries heat away from the building and keeps the interior cooler.

BRIEF DESCRIPTION OF THE DRAWINGS

The foregoing and other objects, features, and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 6 is a perspective view of a portion of one of the walls of stacked tiles of FIG. 5 with a window frame in the stacked tiles;

FIG. 13 is a perspective view of a partially completed module at a second station with the outer wall molds removed as in station B of FIGS. 2 and 4;

FIG. 16 is a perspective view of a nearly completed module similar to that at station B in FIG. 3. It shows a construction end wall with stucco partially applied;

FIG. 17 is a cross-sectional view of the completed module taken on line 17—17 of FIG. 16;

DESCRIPTION OF PREFERRED EMBODIMENTS

Figures 1, 2, 3, 4:
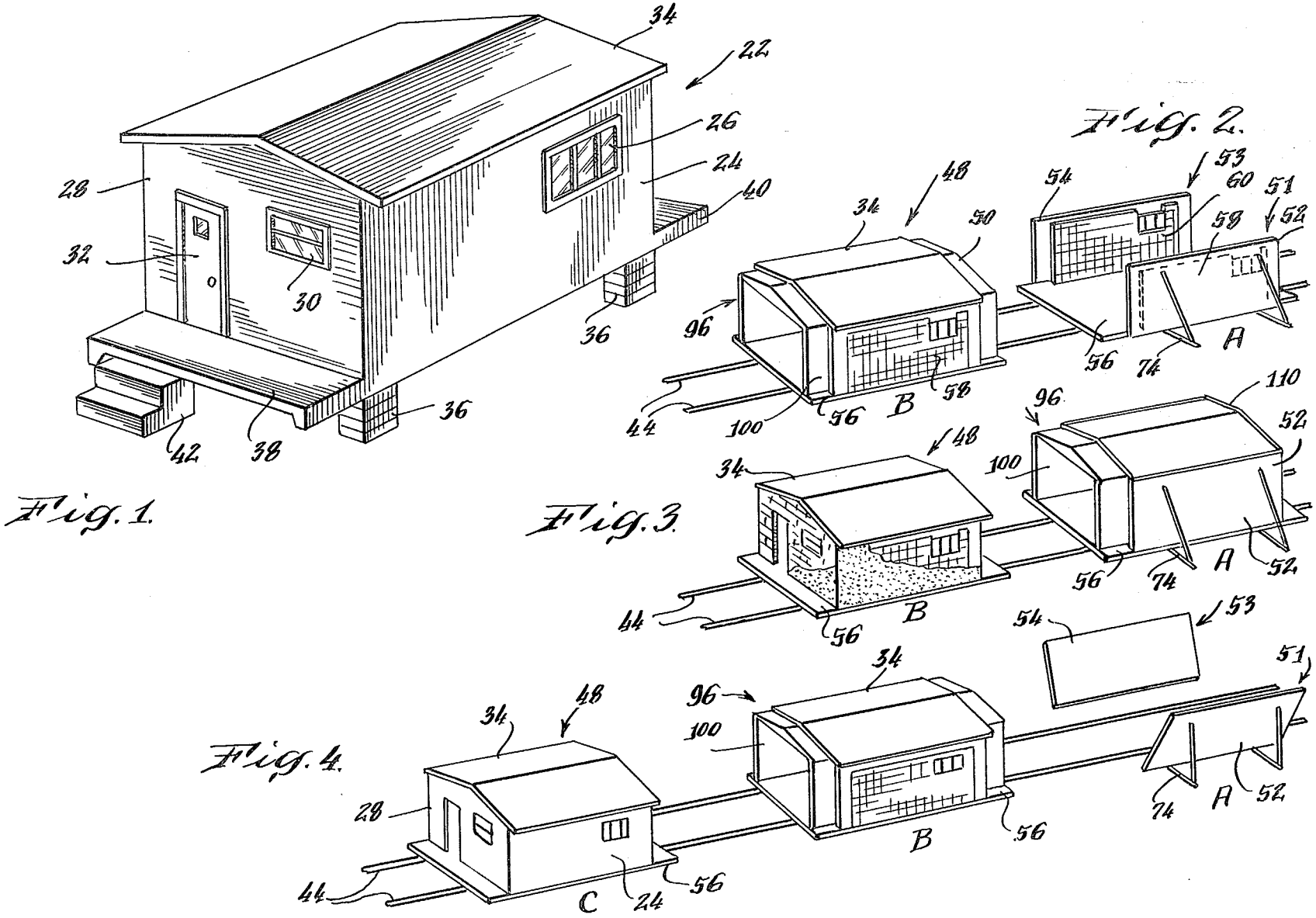
FIG. 1 is a perspective view of a completed module made in accordance with this invention and supported by corner blocks as a one-room structure.
FIG. 2 is a perspective view of an assembly line illustrating the stacking of tiles at station A and a molded but unfinished structure at station B in the sequence of constructing the module of FIG. 1. After each step of assembly, the modules move from right to left as shown in the drawing.
FIG. 3 is a perspective view of the assembly line of FIG. 2 but showing a molding step at station A and a finishing step at station B in the construction of the module.
FIG. 4 is a perspective view of the assembly line of FIGS. 2 and 3 showing a completed module at station C and an unfinished structure at station B.

FIG. 1 shows a monolithic module 22 of the invention supported at its four corners on foundation blocks 36 for use as a single-room building. It includes a sidewall 24 having a window 26 and an end wall 28 having a window 30 and a door 32. The module also includes a gable roof 34. Front and rear porches 38 and 40 are extensions of the concrete floor slab of the module and are integral parts of the basic module. The front porch 38 is further supported by steps 42 formed at the construction site.

Although a single-room building, is shown in FIG. 1, modules constructed according to the invention are readily adapted for use in multiroom buildings. And when the modules are molded with flat roofs, they may even be stacked above one another to construct a high-rise building. In that case, what is herein termed a roof would be the ceiling between floors.

FIGS. 2, 3 and 4 illustrate the molding sequence at a molding station A and a finishing station B. Although the module construction is an assembly line operation, for clarity the construction of only two modules is shown.

At the start of a days work, a partially constructed module 48 having an inner tunnel mold 50 therein is moved along channel rails 44 from station A to its position shown at station B. Outer wall mold structures 51 and 53 are left behind at station A. Then, a floor slab 56 which was poured the previous day and has cured is moved into position between the outer mold structures 51 and 53 as shown at station A. Hollow filler tiles are then loosely stacked on the floor slab 56 against wall molds 52 and 54 of the respective outer wall mold structures 51 and 53 to form tile walls 58 and 60. These tiles are dry-stacked; that is they are not held together by mortar or the like. In order that structural posts and spandrel beams may later be poured around the tile walls, the stacked tiles do not cover the entire wall molds 52 and 54. Bulkheads are moved into position at each end of the wall molds, spaced from the stacked tiles.

Once the tiles are stacked at station A, the inner tunnel mold, including inner wall molds and a roof mold, is collapsed. The tunnel mold is then moved from within the partially constructed module 48 to a position on the floor slab 56 between the stacked tile walls (station A in FIG. 3). The wall molds are then locked in place so that the clay tiles are pressed between inner wall molds and outer wall molds. Additional bulkheads are laid across the roof mold. Thus, the inner mold, outer wall molds and bulkheads can completely contain concrete poured between the inner and outer wall molds and over the roof mold. The concrete is first poured into spaces left at each end of the stacked tile walls to form four corner posts and is then poured over the tile walls to form spandrel beams. Finally, hollow tiles are laid across the roof mold and concrete is poured thereover.

While a module is being molded at station A, the module 48 which was molded on the previous day is being finished at station B as shown in FIG. 3. At station B, end walls are constructed by, for example, stacking and mortaring cinder blocks or the like. Also at station B, the sidewalls and end walls are coated with a skin of stucco.

As shown in FIG. 4, at the start of the following day, the completely finished module is moved from station B to station C and the molded but unfinished module is moved from station A to station B. This begins the next cycle of construction.

The construction cycle has been described as being on a daily basis with each of the floor slab, molded module, and finished module curing over the period of a day. However, shorter curing periods and thus shorter construction cycles are possible if accelerators are used in the concrete.

Figures 4, 5:
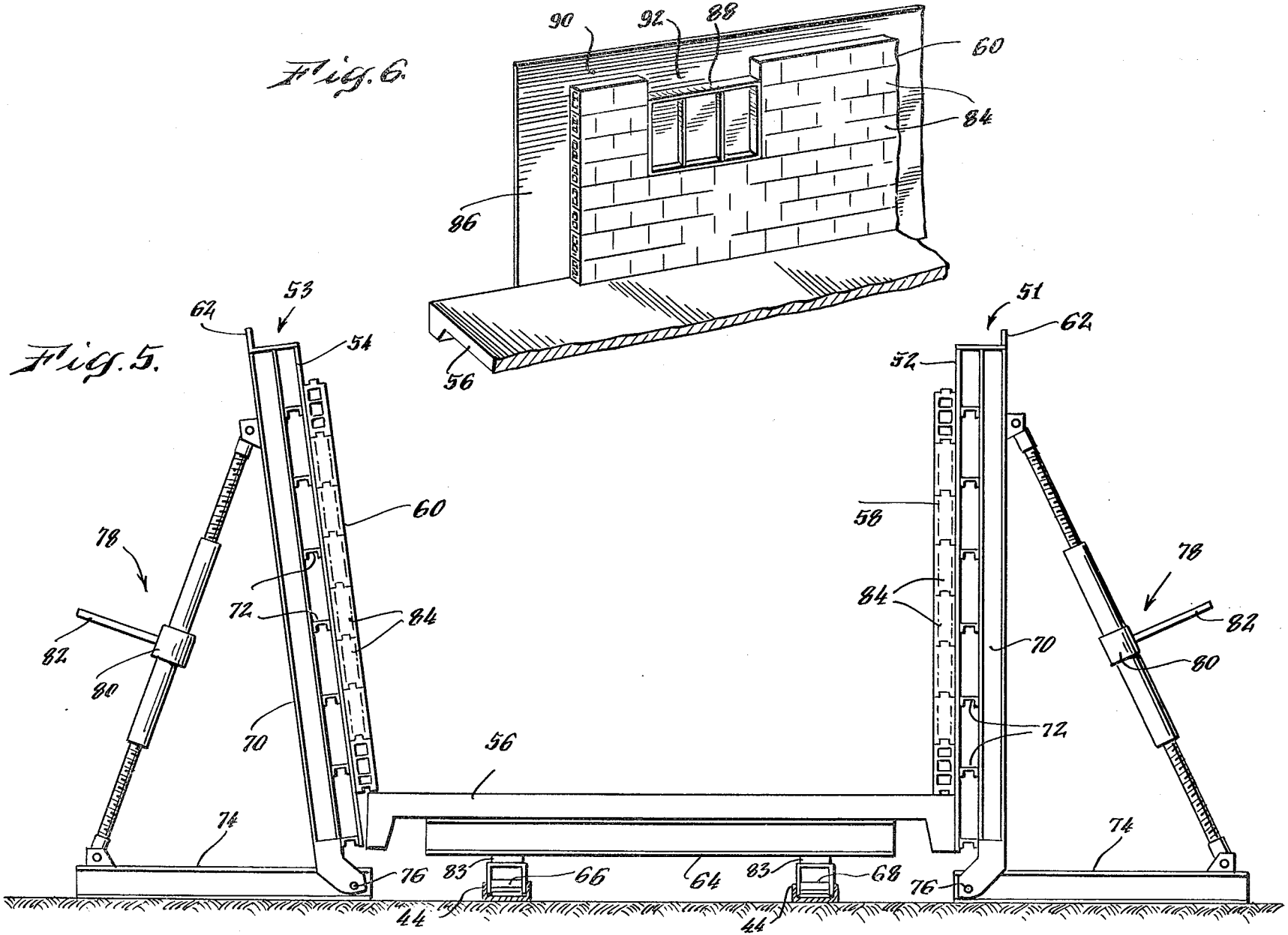
FIG. 5 is an end view of filler tiles stacked on a concrete floor and against outer wall molds as at station A in FIG. 2.

The steps of the above construction method are shown in more detail in FIGS. 5 through 14. As shown in FIG. 5, the concrete floor slab 56 is on an I-beam dolly 64 which is supported by sets of rollers 66 and 68. Each set of rollers is guided by a channel rail 44. Thus, after being placed on the dolly 64 at a floor molding station, the floor slab 56 can be moved into position between the outer wall molds at station A as shown in FIG. 2. The rollers are of the continuous roller type sold under the trademark Triton Rollers by Hilman Equipment Company, Inc.

Permanently positioned at station A, the outer wall mold structures 51 and 53 include wall molds 52 and 54. Each of the molds is supported by a frame-work including at least two vertical I-beams 70. A series of horizontal U-beams 72 extend between the vertical I-beams and support the wall molds 52 and 54 (see FIG. 11). The wall molds may be plywood or the like coated with suitable release agents. The vertical I-beams 70 are pivotally supported by respective I-beam frames 74 resting on the ground. Each wall mold may be pivoted from the angled position of wall mold 54 to the vertical position of wall mold 52 by a turnbuckle arrangement 78. Each turnbuckle 78 may be operated by a handle 82 of a ratchet mechanism 80. Alternatively, an hydraulic mechanism may be used in place of the turnbuckle.

Once the slab 56 on dolly 64 is positioned between the wall molds 52 and 54, it is accurately centered between the wall molds by moving at least one of the molds to its vertical position and thereby pushing the slab 56 to its centered position. To this end, the dolly 64 is supported on rollers 66 and 68 by slide plates 83. These plates are free to slide across the tops of the rollers 66, 68 and thus move with the slab 56 the short distance necessary to center the slab.

To complete the mold, either before or after the clay tiles are stacked, vertical bulkheads 136 (FIG. 11) are set in place and secured at each end of each wall mold. The space 86 (FIG. 6) is left between each vertical bulkhead, the respective tile stack, and the respective wall mold so that concrete can later be poured from above into spaces 86 to form structural corner posts 114.

With the floor slab 56 centered between the wall molds 52 and 54, rows of clay filler tiles are stacked along each wall mold. The tiles have holes therethrough to reduce the amount of clay used, to reduce the weight of the tiles, and to provide an insulating effect. The specific low-density tiles shown in this embodiment are of a tongue and groove configuration; however, the tiles may be completely rectangular in cross-section as shown in the embodiments of FIGS. 20 through 25.

The tiles may be stacked against a vertical wall mold exemplified by mold 52 in FIG. 5, or they may be stacked against a slightly tilted wall mold exemplified by mold 54. The advantage of tilting the mold is that the tiles can be more quickly stacked, with a planar outer surface, and with little concern for their falling inwardly onto the floor 56. No mortar is used during the stacking; the tiles are dry-stacked. After stacking, the inner mold is moved into place, and the outer wall mold 54 can be moved to its vertical position without concern for falling tiles. Since the tiles need not be stacked neatly cost of labor is reduced. In fact, rough abutting surfaces allow the final stucco coating to flow into spaces between the tiles and more securely bind the tiles to one another.

As shown in the perspective view of FIG. 6, a preconstructed window frame 88 may be set in place along with the tiles if desired.

At each end of the stacked tiles, a space 86 is left for pouring concrete to form structural corner posts. A space 90 is also left along the top of the tile wall so that concrete may be poured there to form a spandrel beam. Reinforcing rods (not shown) are suspended in these spaces 86 and 90 to reinforce the subsequently poured concrete. A space 92 may be left above the window for pouring a concrete lintel, although the lintel is not always necessary.

Figure 7:
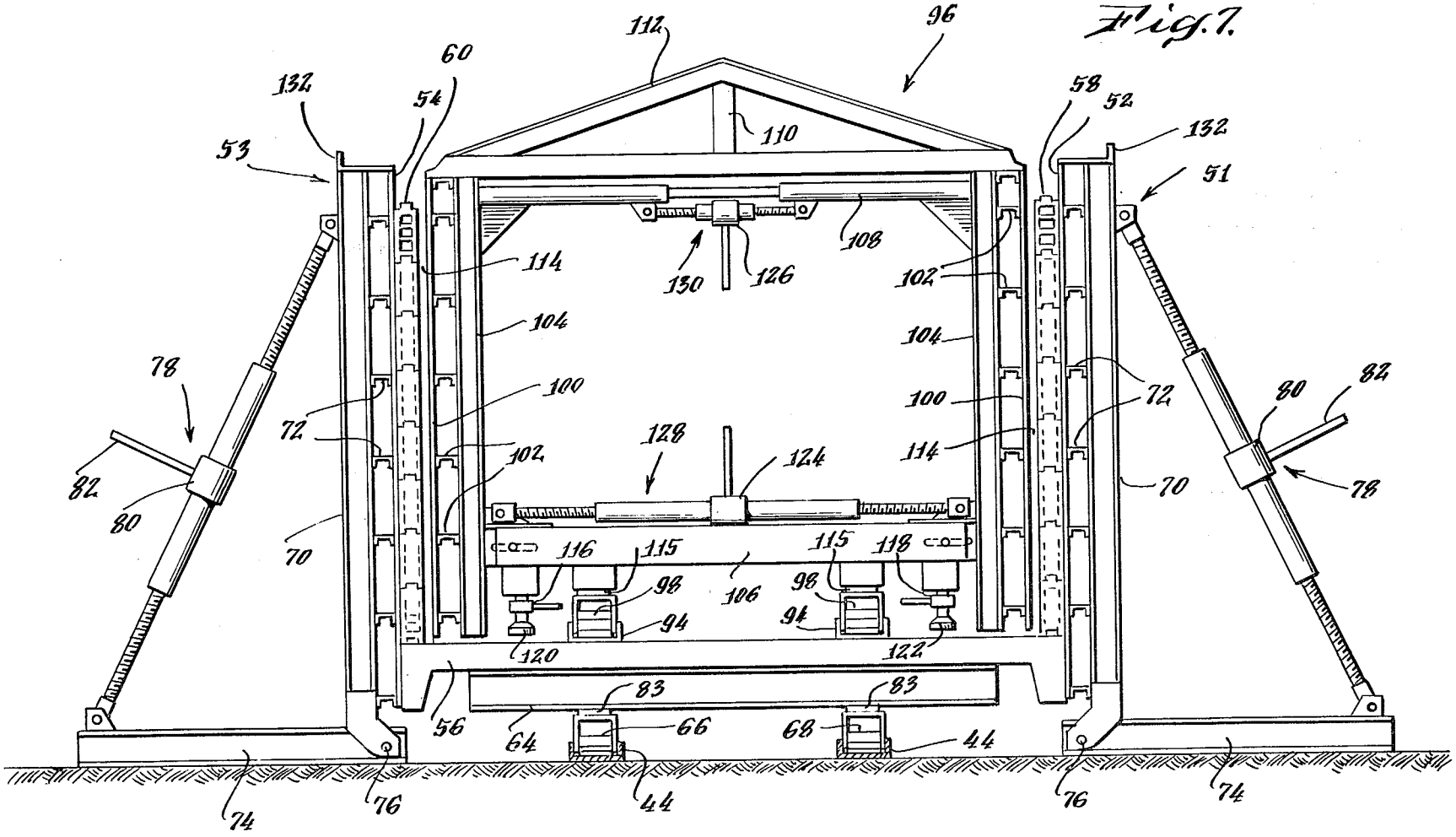
FIG. 7 is an end view similar to FIG. 5 but with an inner tunnel mold moved into place between the walls of stacked tiles as in station A of FIG. 3.

Once the tiles are stacked along the outer wall molds, an inner tunnel mold 96 is moved from within the module at station B onto the slab 56 at station A (FIG. 7). The tunnel mold 96 is guided by sets of rollers 98 which ride in channel rails 94 placed on the slab. The channel rails 94 evenly distribute the weight of the tunnel mold along the length of the slab 56 to reduce the possibility of cracking it. At least four sets of rollers 98 ride along each channel rail 94. The distances between those sets of rollers and the gap between the slab of module 48 and slab 56 are such that the inner mold 50 is at all time supported by one or both of the slabs.

Tunnel mold 96 includes inner wall molds 100 supported by horizontal U-beams 102 which extend between vertical I-beams 104. The vertical I-beams 104 are joined by a telescoping crossbeam 106 and a telescoping pipe 108. A roof frame 100, which supports a plywood roof mold 112, is supported on and slideable relative to the vertical I-beams 104. Suitable stops (not shown) are provided to prevent the inner wall molds 100 from moving outwardly beyond the roof frame 110 with telescoping of the beam 106 and pipe 108.

When the tunnel mold is moved onto the slab 56, it is in a collapsed state so that a narrow space 114 is left between the molds 100 and the tile walls 58 and 60. Also, the roof mold 112 is slightly below its ultimate molding operation.

Once the tunnel mold is positioned between the tile walls 58 and 60, hand-operated ratchets 124 and 126 are used to extend the telescoping beam 106 and pipe 108 by turnbuckle arrangements 128 and 130. The inner wall molds 100 are thus moved to their outermost positions. Then, the outer wall molds 52 and 54 are raised to their vertical positions. If the inner mold 96 is in other than a centered position, one of the walls of stacked tiles and the respective vertical bulkheads press against an inner wall mold and cause the latter to slide on slide plates 115.

With the inner mold centered, the inner wall molds 100 are again collapsed and the entire inner mold 96 is lifted by means of hand-operated ratchets 116 and 118 on screw jacks 120 and 122. The screw jacks 120, 122 are shown to either side of the rollers 98 for clarity. However, these jacks would actually be in line with the rollers so that the jacks press between the inner mold 96 and the channel rails 94. The rails thus continue to distribute the weight of the inner mold 96.

Finally, the inner wall molds 100 are again expanded against the stacked tiles. The inner mold is thereby locked into the position shown in FIG. 8; the roof mold 112 is in a slightly elevated molding position and the inner wall molds 100 press the filler tiles against the outer wall molds 52 and 54. The space beneath each inner wall mold 100 is then blocked-off by a board or the like of suitable width.

Figure 10:
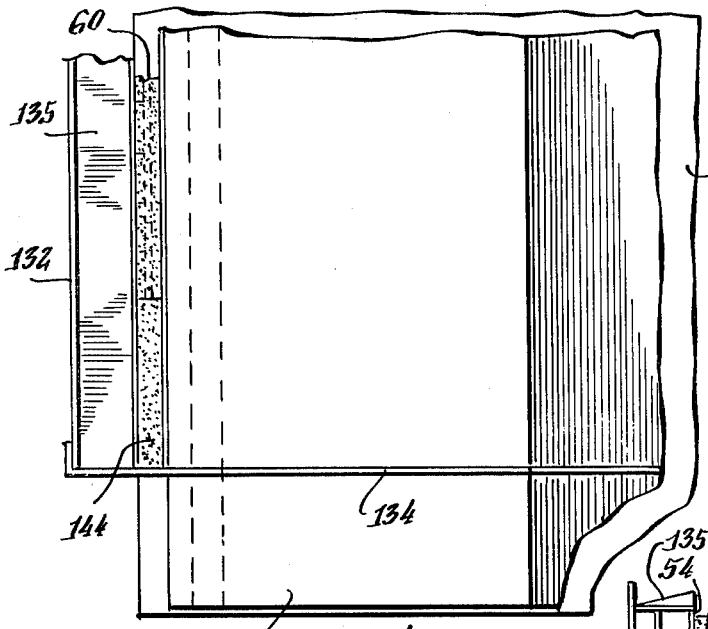
FIG. 10 is a partial plan view of the mold with the bulkhead in place as in FIG. 9 and with a structural post poured.
Figure 8:
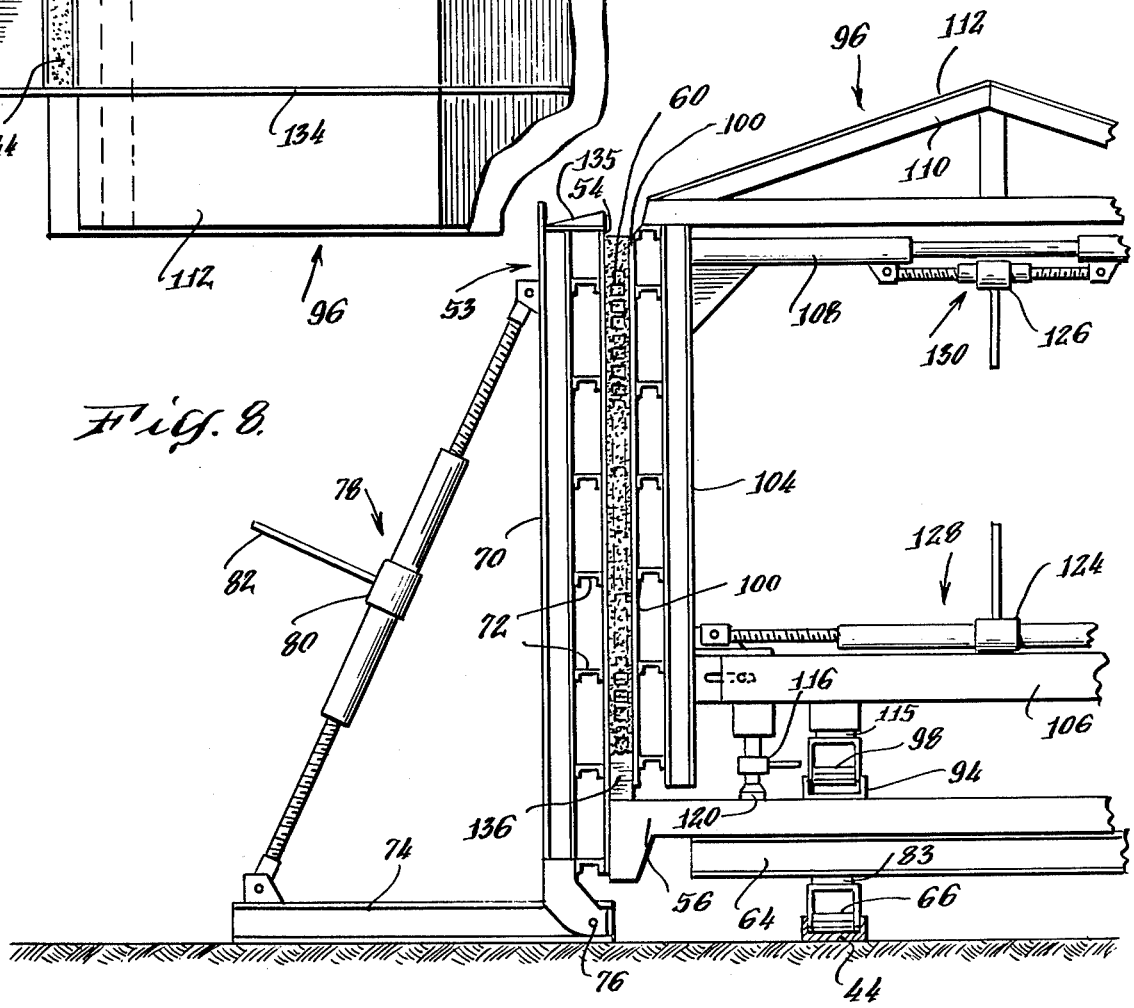
FIG. 8 is a partial end view similar to FIG. 7 but with the inner wall molds moved outwardly into their locked-in position, pressing the tiles against the outer wall molds.
Figure 9:
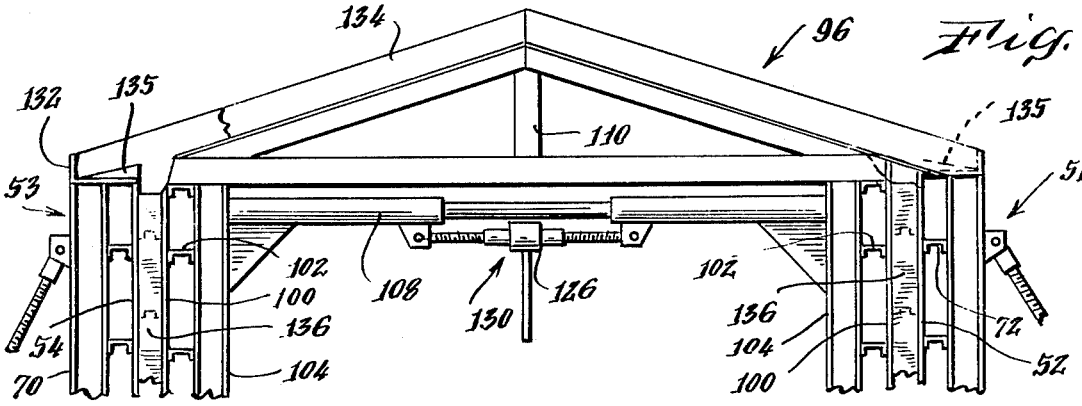
FIG. 9 is a partial end view with the inner wall molds in their locked-in position as in FIG. 8, and with a bulkhead on the roof of the inner mold for framing a poured concrete roof.
Figure 11:
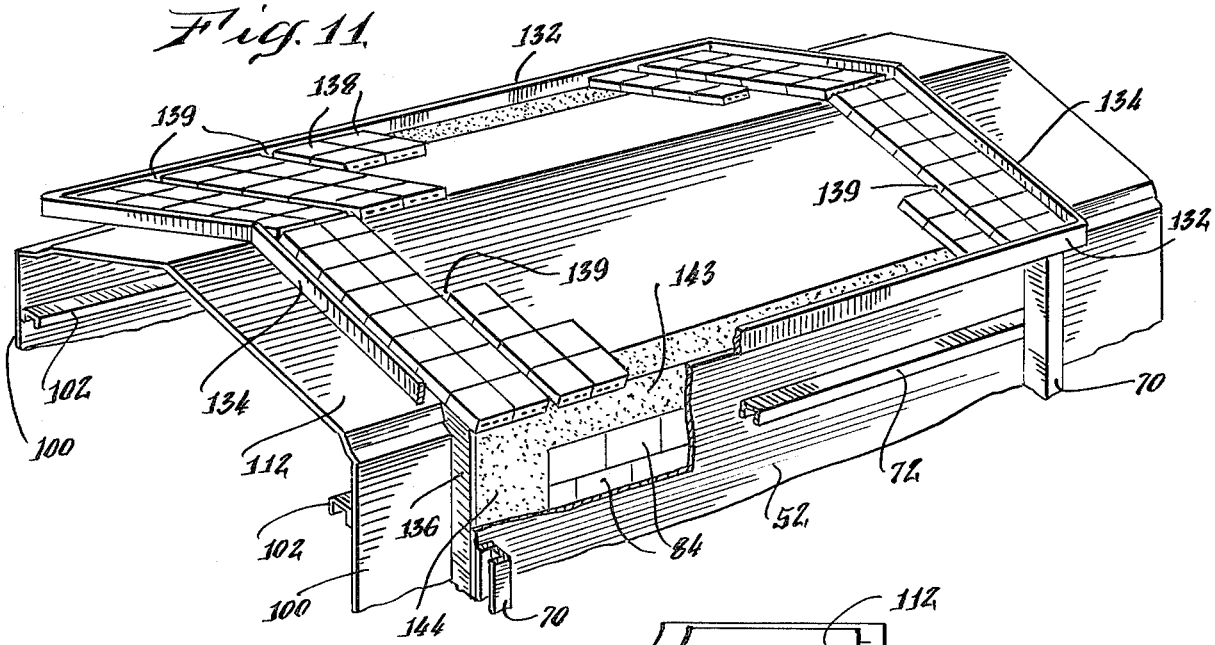
FIG. 11 is a perspective view of the top of the mold with tiles partially laid within the bulkhead and with the outer wall mold broken away to show the poured structural corner post and spandrel beam.
Figure 12:
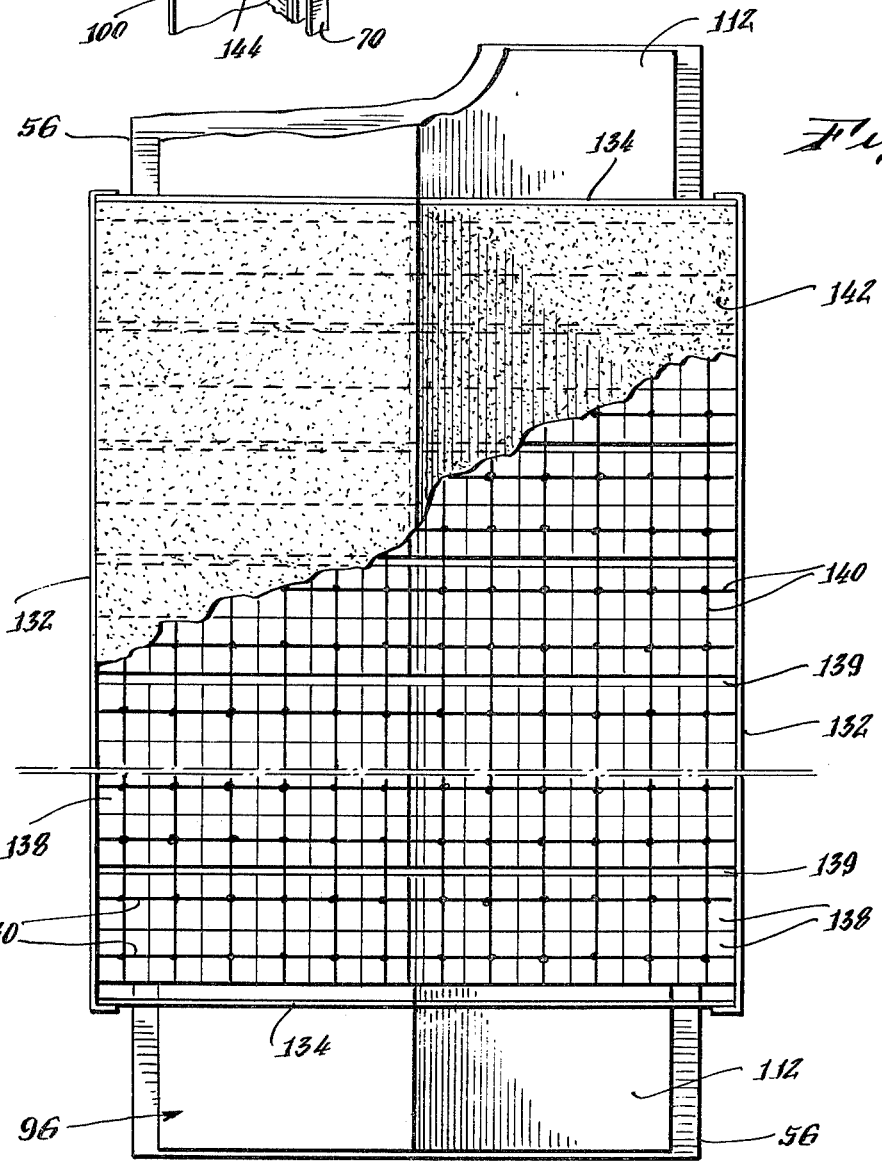
FIG. 12 is a view of the mold from above with roof tiles and reinforcing rods completely laid across the roof and with concrete partially poured over the tiles and rods.

As best shown in FIGS. 9, 10 and 11 a side bulkhead 132 extends upwardly from each outer wall mold structure 51 and 53. Once the tunnel mold is locked in place, additional end bulkheads 134 are laid across the roof mold 112 and are connected to the side bulkheads 132 to complete the roof molding frame. These bulkheads 132 and 134 retain concrete later poured onto the roof. Also, a wood block 135 (FIG. 8) extending the length of each outer wall mold 52, 54 is laid thereon to define the underside of the eaves of the subsequently poured roof.

With the mold completed, concrete is poured from above the space 86 along reinforcing rods to form structural corner posts 114. Also, concrete is poured across the top of the tiles in the space 90 (FIG. 6) to form the spandrel beam 143. The weight of the poured concrete of the spandrel beam places the tiles 58 and 60 in compression and holds them tightly together.

In order to reduce the amount of concrete required in the roof, tiles 138 are laid across the roof mold 112 and across the freshly poured spandrel beam. Those tiles are shown partially laid in FIG. 11. For reasons to be discussed, the tiles are arranged in rows so that holes passing therethrough are aligned to form channels running from the eaves of the roof toward its peak, and as shown in FIG. 11 these tile rows are arranged with a space 139 left between every other row.

Once the bulkhead frame is filled with tiles, a web of reinforcing rods 140 is laid across the tiles. Finally, concrete 142 is poured across the entire roof within the bulkhead frame. The concrete is shown partially poured in FIG. 12.

In an alternative reinforcing scheme, reinforcing rods are placed within the spaces 139 between tiles, and a wire mesh is embedded in the concrete poured over the tiles. Also, tiles are not laid over each of the four corner posts and the reinforcing rods in the corner posts are joined to those in the roof.

As noted above, every other row of tiles in the roof is spaced. Consequently, the concrete poured in the spaces 139 forms structural ribs 141 extending between the eaves of the module across the peak. Also, a continuous sheet of concrete is formed over the tiles, completing the concrete portion of the module.

Thus, concrete is used only in the floor, in the four corner posts, in the spandrel beams and in a relatively thin sheet with supporting ribs across the roof. Consequently, the amount of concrete used is substantially reduced from that used in conventional prefabricated modules.

Figure 14:
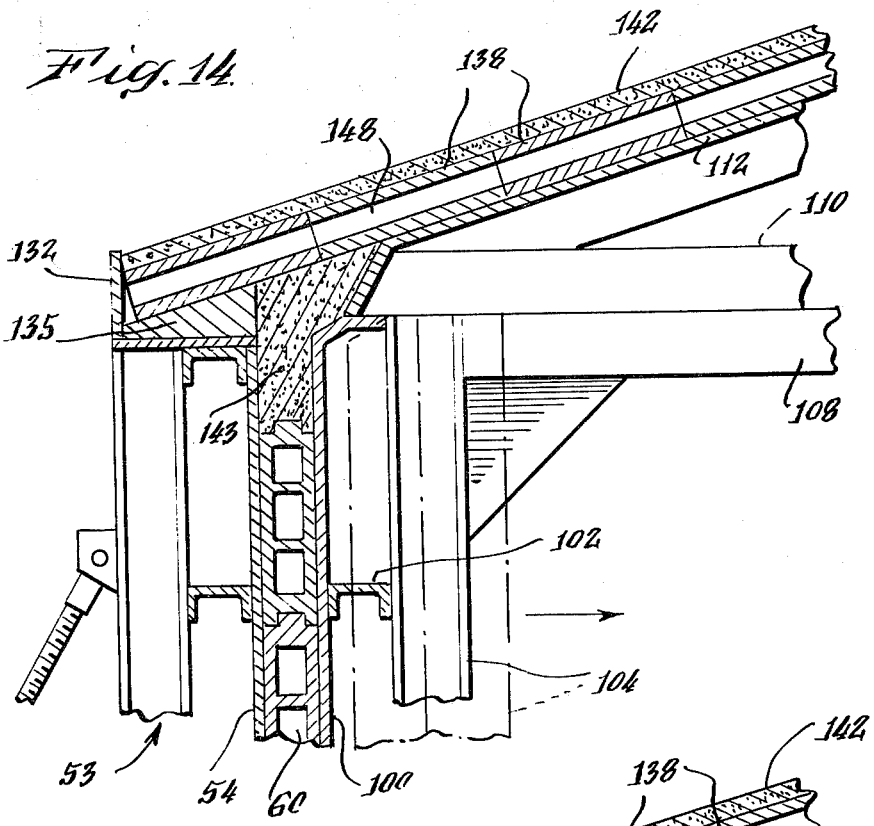
FIG. 14 is a partial, transverse sectional view of the module and mold after the concrete has been poured.

Once the concrete is poured, the inner mold 96 and the outer wall mold structures 51 and 53 are left in place as shown in FIG. 14 until the concrete cures. Then, on the following day, the outer mold structures 51 and 53 are angled outwardly by the turnbuckles 78. The outer wall structures squeeze by blocks 135 and the blocks then fall from under the eaves of the roof.

As can be seen in FIG. 13, the molded structure comprises a concrete floor slab 56, four concrete corner posts 144, two concrete spandrel beams 143, lintel 147, and a concrete and tile roof 34. Dry-stacked tiles 58 are held in compression between the spandrel 143 and the floor slab 56 and between the corner posts 144. The compression increases the friction between the stacked tiles and thus the stability of the walls.

With the inner mold still in place as shown in FIG. 13, the partially completed module is then moved on the dolly 64 along the rails 44 to the station B (FIGS. 2 and 3). By leaving the inner wall mold in position during movement of the partially completed module, there is no likelihood that the module will collapse during movement before the concrete has completely cured, and wobbling of any loose tiles is prevented. The tiles are exposed during this movement to the second station but are held in place by friction resulting from the compressive force applied primarily by the spandrel beam during the molding process.

The spandrel beam 143 is shown as a concrete beam below the roof. However, the spandrel beam might be within the roof and not extend below. The important thing is that the concrete spandrel beam structurally join the corner posts and that, when poured, it weigh down on the stacked wall tiles to place the tiles in compression.

Figure 15:
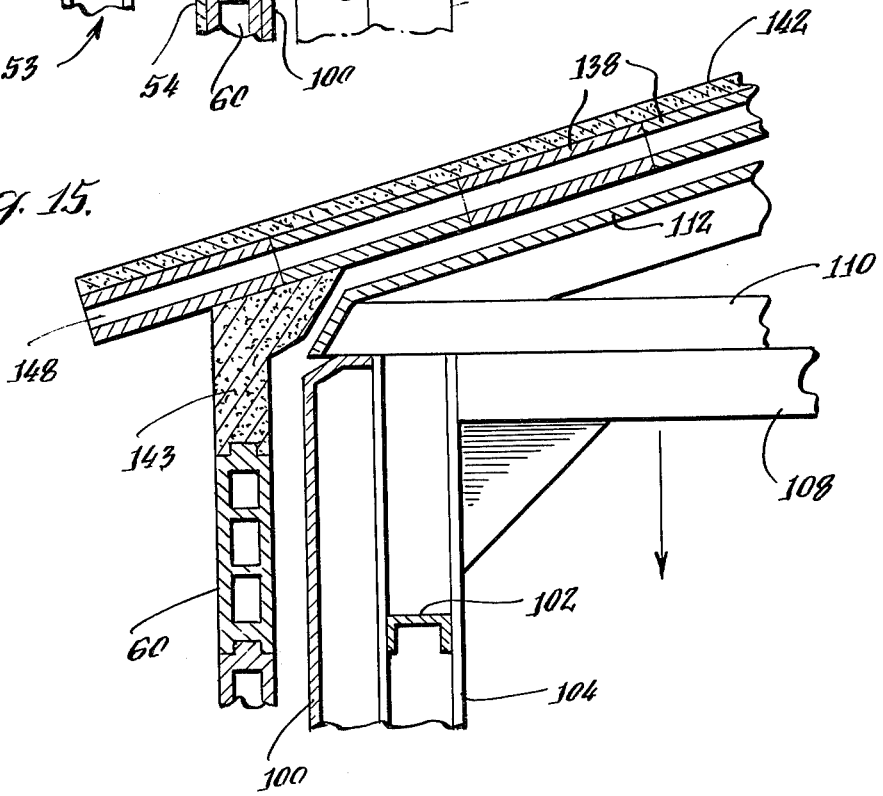
FIG. 15 is a partial sectional view similar to FIG. 14 but with the wall molds removed from the module walls.

Once the modules has been moved to station B, the inner mold is collapsed by first withdrawing the inner wall molds 100 as indicated by the broken lines of FIG. 14 and then dropping the entire inner mold 96 onto the rollers 98. As shown in FIG. 15 the inner wall mold breaks away from the module wall when moved inwardly. Then, the roof mold breaks away from the module roof when the inner mold is dropped.

As shown in FIG. 14, the outer edge of the roof mold 112 is set in from the wall mold 100 when the mold is locked in its molding position. And the edge is angled inwardly from the wall 100. Thus, the edge of the roof mold 112 pulls loose from the module wall when the mold is dropped as shown in FIG. 15.

The collapsed inner mold may then be taken from the module and moved back to station A to another floor slab moved into position between the tilted outer mold structures 51 and 53. Meanwhile, the roof tiles 138 and wall tiles 84 remain encapsulated in the molded concrete of the module.

At station B (FIG. 16), end walls 145 are constructed in the module. These walls may be mortared cinder block or the like and may include windows or doors. Mortaring of the end walls is preferred because these walls are not in compression and without mortar would be less stable than the sidewalls. Stucco 146 is applied to the outside of both the side and end walls at the second station, and plaster may be applied to the insides of the walls. The stucco and plaster complete the monolithic structure. In the ultimate structure the sidewalls are held together both by the stucco and plaster and by friction resulting from compressive forces placed on them during the molding operation.

As an alternative to cinder block end walls, those walls may be prefabricated and may simply be of wood or any other suitable material. The end walls merely complete the enclosure and are not required for structural strength. Thus, the module is structurally complete without the end walls but with stucco applied to the sidewalls.

Figure 18:
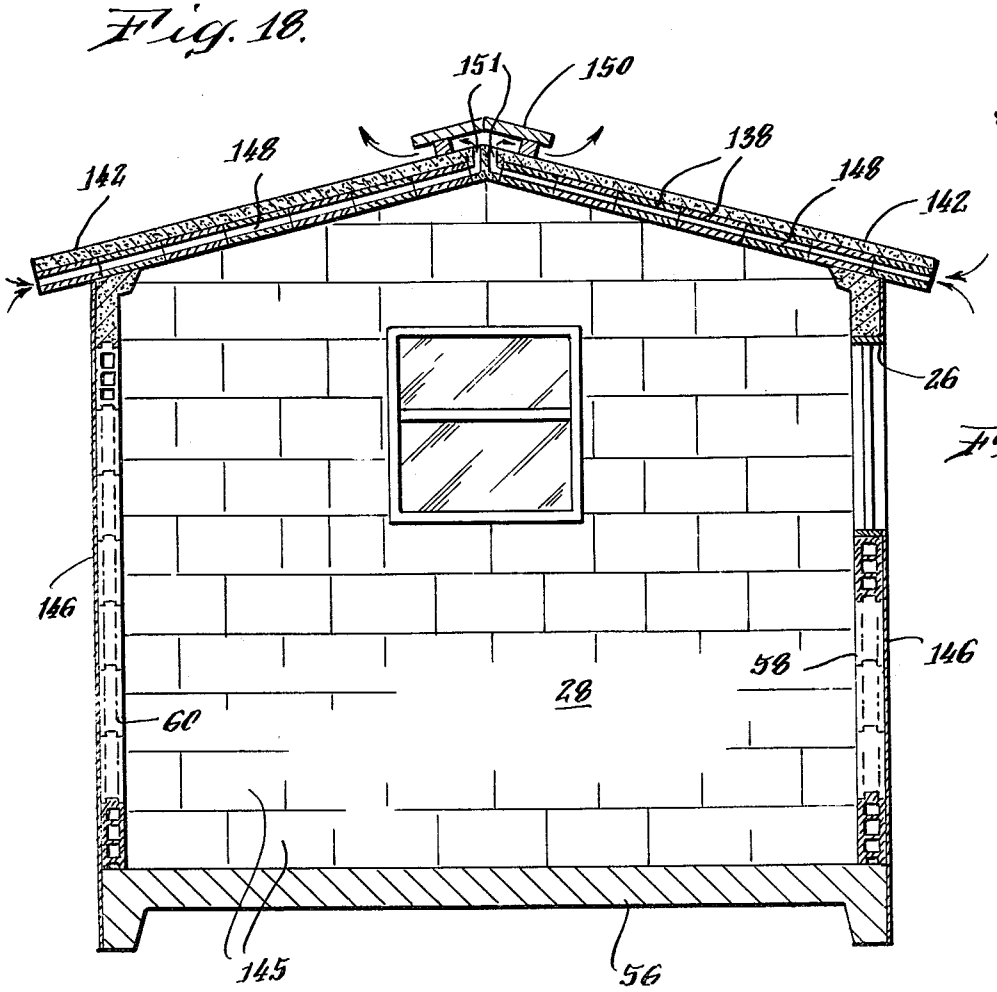
FIG. 18 is a transverse cross-sectional view of a completed module with convective roof ventilation and a watershedding cap in accordance with a preferred embodiment.

A transverse cross-sectional view of a preferred embodiment of a gable roof module is shown in FIG. 18. As noted above, the roof tiles 138 are aligned so that the holes passing therethrough form channels 148 running from the eaves to near the peak of the roof. Before concrete is poured over the roof, generally vertical plugs are positioned at the peak ends of the channels. These plugs may be tubular and may be clay or the like. The plugs can be broken away after the concrete roof is poured to provide apertures 151 into the channels 148 along the peak of the roof. Thus after the concrete is poured both ends of the channels 148 are exposed to the atmosphere as shown in FIG. 18. Heating of air within these channels by sunlight causes convective movement of the air in channels 148. Thus, there is a natural upward movement of air though the roof to cool the module. A cap 150 is provided over the peak and extends the entire length of the roof to shed water and thus prevent rain from entering the channels 148.

Figure 21:
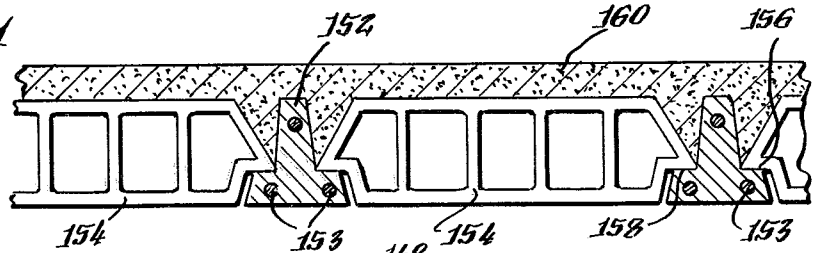
FIG. 21 is a partial longitudinal cross-sectional view of the roof in the embodiment of FIG. 20.
Figure 19:
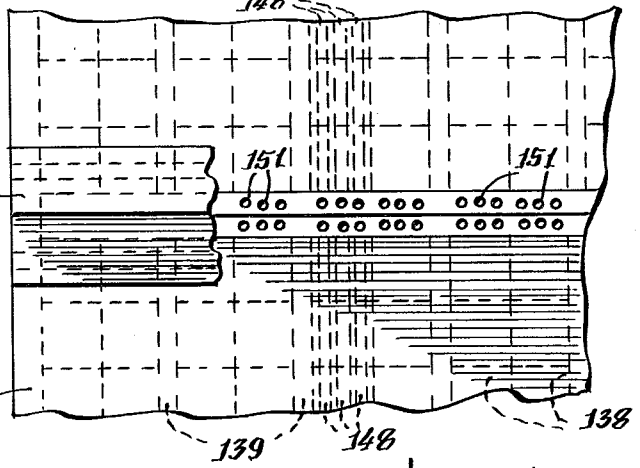
FIG. 19 is a partial plane view of the module of FIG. 18 with the roof cap partially broken away to show exposed ventilation channels.

To avoid the requirement of the roof mold on the inner mold 96, purlins may be utilized, as shown in the embodiments of FIGS. 20 through 23. In these embodiments a flat roof, either horizontal or pitched, is formed by resting precast concrete beams or purlins 152 across the inner mold walls. The purlins 152 include embedded reinforcing rods 153 extending along their lengths. Specially formed tiles 154 rest on respective pairs of purlins and span the space therebetween. For example, as shown in FIG. 21, each purlin may include steps 156 which extend across the module between stacked tile walls, and each tile may include a complementary niche 158 which rests on the step 156. The tiles and purlins are then covered with concrete 160 and the completed roof includes the supporting purlins 152, the filler tiles 154, and a concrete top 160. As before, the stack of tiles 60 is compressed below a spandrel 143.

In these embodiments, there is no need for blocks 135 under the eaves of the roof. Rather, a board or plate 137 forms the top surface of each outer mold structure to support the eaves of the roof. Each board 137 is wedge shaped in order that the outer mold structures 51 and 53 be free to pivot outwardly after the eaves of the roof have been poured. The board 137 is preferably permanently fixed to the wall mold structure.

Figure 20:
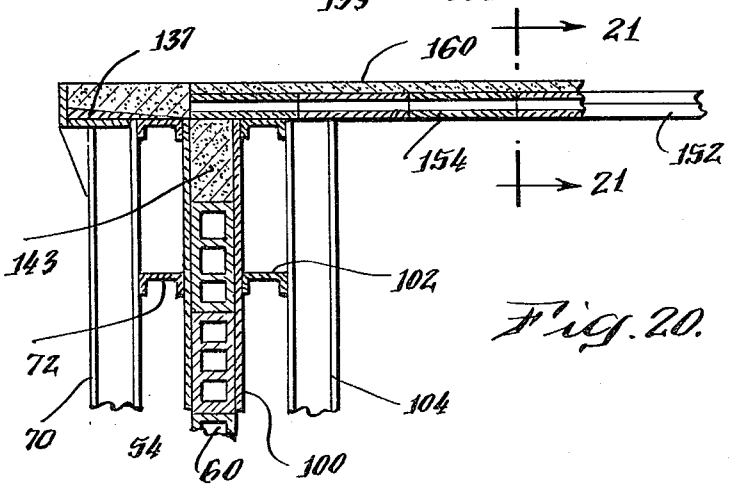
FIG. 20 is a partial transverse cross-sectional view of another embodiment in which a flat roof is formed using purlins and without the need for a roof mold.

The flat horizontal roof shown in FIG. 20 is particularly suitable for buildings which require that modules be positioned one above the other as in a high-rise building. The inner mold for this embodiment includes inner wall molds 100 joined by telescoping beams as before but does not include a roof mold. As with the gable roof embodiment the inner mold is raised to the position shown in FIG. 20 by jacks.

Figures 22, 23:
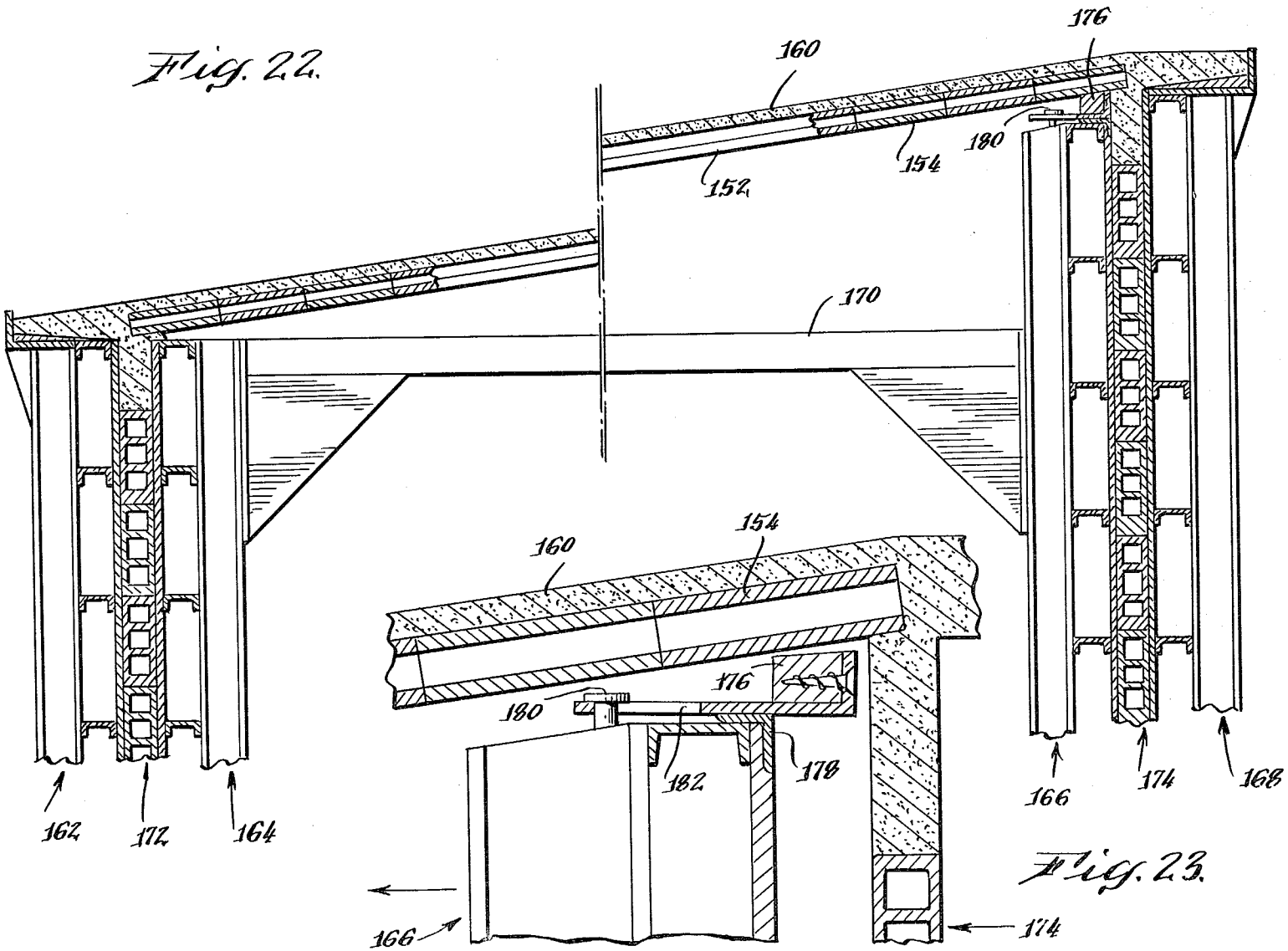
FIG. 22 is a partial transverse cross-sectional view of yet another embodiment in which a pitched roof is formed using purlins and without the need for a roof mold.
FIG. 23 is an enlarged view of the upper right portion of FIG. 22 with the wall molds removed from the module wall.

FIG. 22 shows an embodiment with purlins and having a shed roof. In this embodiment the inner and outer mold structures are taller on one side of the module than on the other. Thus, outer wall mold structure 162 and inner wall mold structure 164 are at one height, and inner mold structure 166 and outer mold structure 168 are at heights somewhat above the structures 162 and 164. (For simplicity, only portions of the roof are shown; note the broken line at the center). As before, the inner mold structures are joined by a telescoping frame including crossbeam 170 so that they may be pressed outwardly against the respective stacks of tile 172 and 174. With the inner structures 164 and 166 pressed against the stacked tiles, purlins are rested thereon to span the module. The tiles 154 are then rested on the purlins to completely cover the module. Finally, concrete is poured over the purlins and tiles.

The roof tiles 154 supported on the purlins have through holes aligned to form channels as in the gable roof. The tiles may be positioned so that the channels extend to the outer edges of the eaves of the roof. Alternatively, as shown in FIG. 22 the tiles may lie short of the eaves. In that case, in order to open the channels to the atmosphere for convection, plugs would be used during molding to form apertures through the concrete as discussed with respect to the gable roof. In either case, some means for shedding rain water, similar to the cap 150 in the gable roof embodiment, would be provided.

A slide mechanism is provided at the top of the taller inner mold wall 166 (FIGS. 22 and 23). This slide mechanism includes a board 176 to fit snugly between the mold structure 166 and the inclined purlins 152 when the inner mold is in its locked-in molding position. The board 176 is slideable relative to the mold structure 166 so that, when the structure is moved inwardly, the board remains behind. Then, when the inner mold is lowered, the board 176 pulls free as shown in FIG. 23. The board 176 does not fall between the collapsed inner mold and the module wall because it is connected to the mold structure 166 by a pin 180 which rides in a slot 182 of angle iron 178.

When the inner mold is collapsed, the shorter inner wall mold structure 164 moves away from the stacked tiles 172 and, due to the upward incline of the roof, remains spaced both from the stacked tiles 172 and from the upwardly angled purlins 152 and roof tiles 154. Thus, both inner wall mold structures pull away from the module walls and from the roof when the inner mold is collapsed. And the inner mold can be freely moved out of the molded structure.

Figure 24:
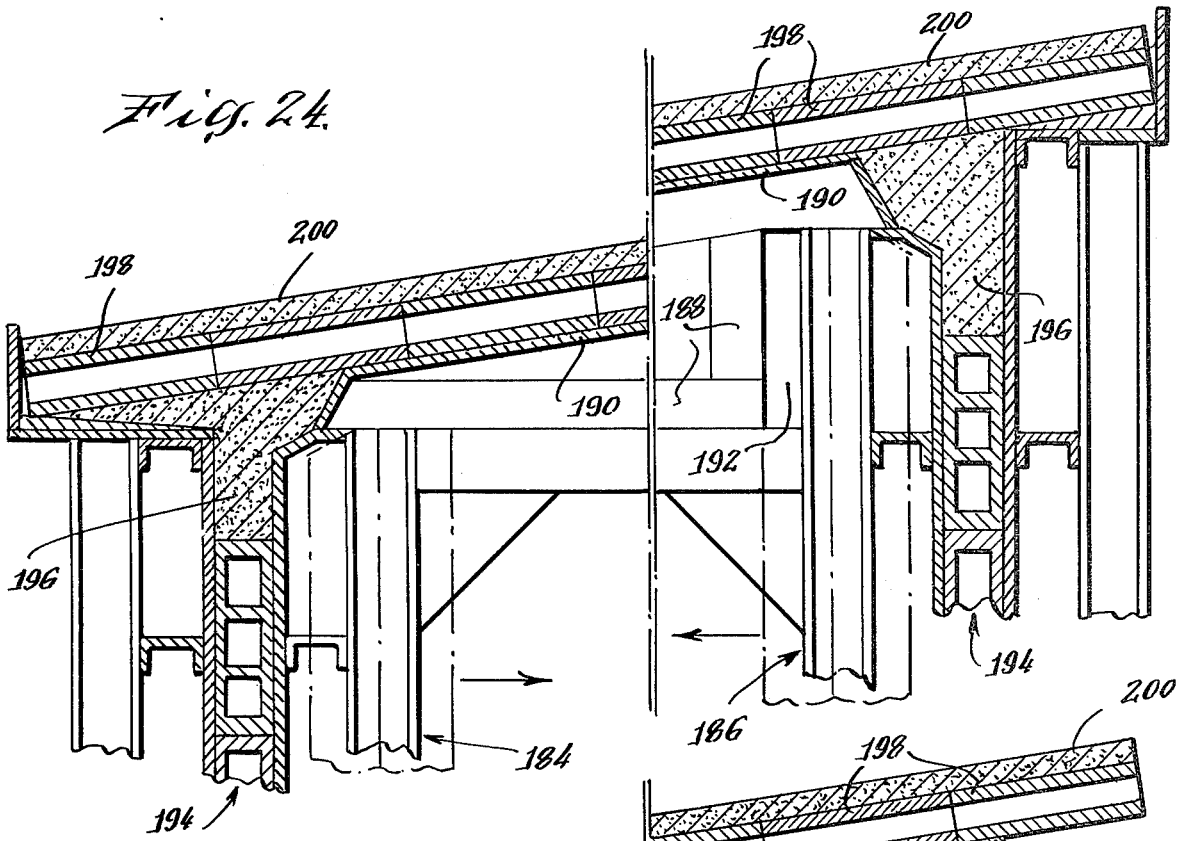
FIG. 24 is a partial transverse cross-sectional view of another embodiment in which a pitched roof is formed using a roof mold.
Figure 25:
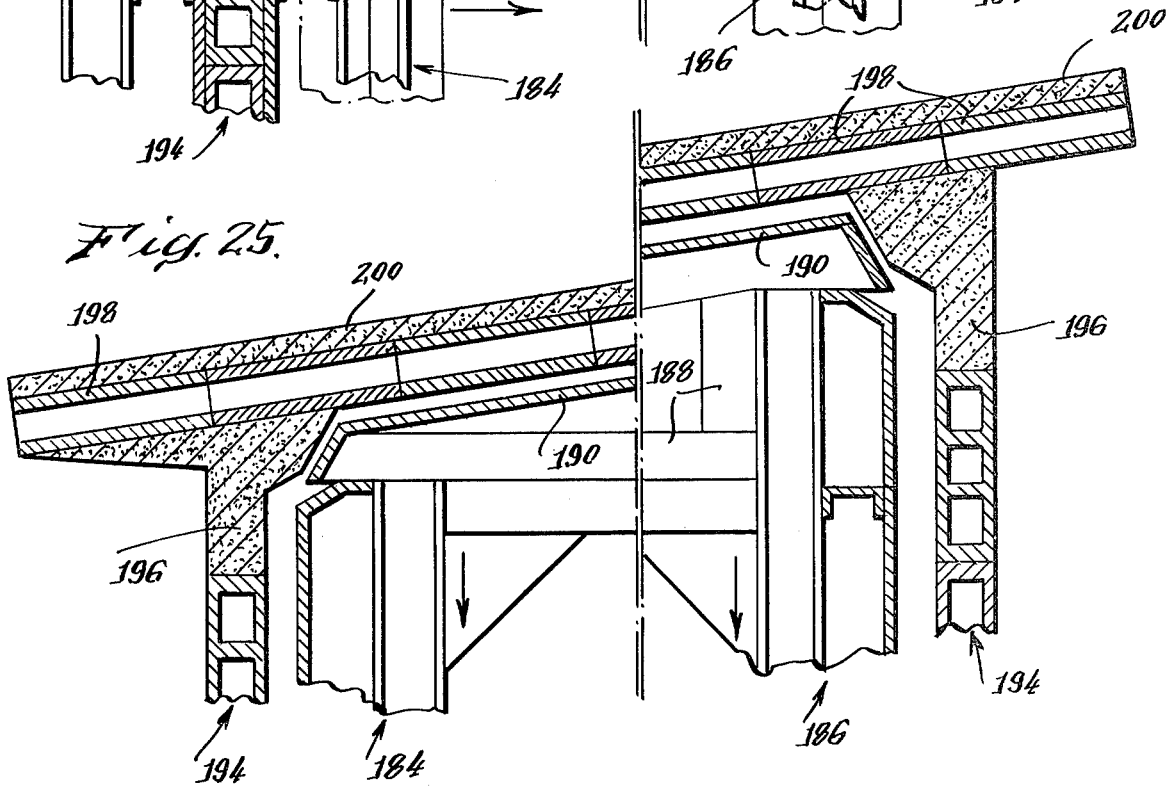
FIG. 25 is a partial transverse cross-sectional view of the module of FIG. 24 but with the wall molds removed from the module wall.

A shed roof embodiment having a roof construction similar to that of the gable roof first described is shown in FIGS. 24 and 25. The inner mold used in this embodiment includes an inner wall mold structure 184 and a taller inner wall mold structure 186. A roof mold frame 188 is slideably supported by these mold structures 184, 186 and in turn supports a roof mold 190. With the inner mold in its locked-in position of FIG. 24, there is a space 192 between the wall mold structure 186 and the roof mold frame 188.

As with the gable roof, the inner mold is locked in place to press the stacked tiles 192 against the outer wall molds. Then, four concrete corner posts and two concrete spandrel beams 196 are poured around the tiles. Roof tiles 198 are laid across the mold roof 190 and spandrel beams 196, and these tiles 198 are covered with a mesh of reinforcing rods and a layer of concrete 200.

When the inner mold is to be removed from the molded structure of two inner wall mold structures are moved toward each other. The taller wall mold structure 186 moves into the space 192 against the roof mold frame 188. The entire inner mold is then dropped by jacks as with the gable roof, and the mold roof 190 completely breaks away from both the module walls and the module roof as shown in FIG. 25.

Figure 26:
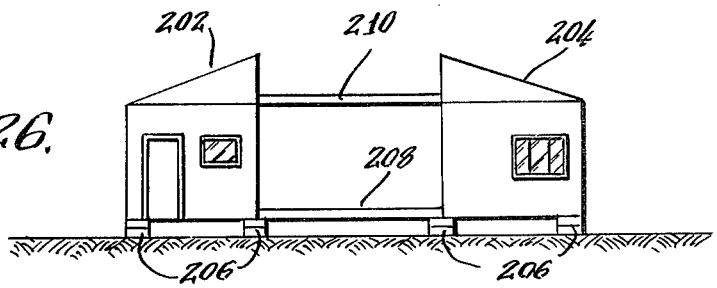
FIG. 26 is an alternative building configuration using two pitched roof modules.

As noted above, the prefabricated modules may be combined to form multiroom buildings. One configuration of a multiroom structure is shown in FIG. 26. Two shed roof modules 202 and 204 are supported on respective sets of foundation blocks 206. A prefabricated concrete floor slab 208 is placed on the same foundation blocks, and a roof slab 210 is suspended between the modules by suitable means. The two slabs 208, 210 thus form a patio which may be closed by end walls to form a third room.

While the invention has been particularly shown and described with reference to preferred embodiments thereof, it will be understood by those skilled in the art that various changes in form and details may be made therein without departing from the spirit and scope of the invention as defined by the appended claims.

I claim:

1. The method of forming a monolithic room-enclosing module comprising the steps of providing a unitary wall-supporting base slab;

dry-stacking a plurality of rows of blocks on said base slab to form the major portions of at least two opposed module walls; and thereafter pouring a plastic structural material into a first mold adjacent one end of each wall of dry-stacked blocks to form structural posts at least at one end of each module wall of said dry-stacked blocks but not substantially within or between the individual blocks, said structural posts providing lateral support for said dry-stacked blocks;

pouring a plastic structural material into a second mold over the top of each module wall of said dry-stacked blocks to form a structural spandrel beam over each wall of said dry-stacked blocks, the weight of said spandrel beam acting on said dry-stacked blocks therebelow to hold said dry-stacked blocks in close compressive relationship with each other for providing each of said module walls with structural stability;

joining said spandrel beams with a roof spanning said base slab; and coating at least one face of each of said module walls of dry-stacked blocks with a skin of cementitious material after removal of said first and second molds to provide a continuous surface coating over said at least one face of each of said module walls.

2. The method of forming a monolithic room-enclosing module as claimed in claim 1 wherein said dry-stacked blocks are pressed between inner and outer wall molds and said structural posts and structural spandrel beams are poured between those same inner and outer wall molds.

3. The method of forming a monolithic room-enclosing module as claimed in claim 1 wherein said roof is formed by laying blocks across a roof mold in rows with spaces between rows of blocks extending between said structural spandrel beams and pouring a plastic structural material over said rows of blocks, structural material flowing into the spaces between the blocks forming structural ribs.

4. The method of forming a monolithic room-enclosing module as claimed in claim 3 wherein said roof is pitched and said blocks have holes therethrough and are aligned to form channels extending from the eaves of the module toward its peak, and said channels are exposed to the atmosphere at each end thereof after the concrete is poured in order to convect heated air therethrough.

5. The method of forming a monolithic room-enclosing module as claimed in claim 1 wherein said stacked blocks have an interengaging tongue and groove configuration.

6. The method of forming a monolithic room-enclosing module comprising the steps of providing a unitary wall-supporting base slab between opposed outer wall molds;

dry-stacking a plurality of rows of blocks on said base slab against each of said outer wall molds to form the major portions of at least two opposed module walls, but not dry-stacking said blocks in spaces at each end of said wall molds and at the tops of said wall molds;

providing an inner mold on said base slab between said two opposed module walls of dry-stacked blocks with said blocks pressed between said inner mold and said outer wall molds; and thereafter pouring a plastic structural material between said inner mold and said outer wall molds at each end of said module walls of dry-stacked blocks to form structural posts but not pouring said plastic structural material substantially within or between the individual blocks, said structural posts providing lateral support for said dry-stacked blocks;

pouring a plastic structural material between said inner mold and said outer wall molds over the top of each of said module walls of dry-stacked blocks to form a structural spandrel beam over each of said module walls, the weight of said structural spandrel beam acting on said dry-stacked blocks therebelow to hold said dry-stacked blocks in close compressive relationship with each other for providing each of said module walls with structural stability;

supporting a roof on said structural posts and said structural spandrel beams;

moving said inner mold and said outer wall molds away from said module walls; and coating at least one face of each of said module walls of dry-stacked blocks with a skin of cementitious material to provide a continuous surface coating over said at least one face of each of said module walls.

7. The method of forming a monolithic room-enclosing module as claimed in claim 6 wherein said outer wall molds are tilted away from said wall supporting base slab when said blocks are dry-stacked against said outer wall molds.

8. The method of forming a monolithic room-enclosing module as claimed in claim 6 wherein said roof is formed by laying blocks across a roof mold in rows with spaces between rows of blocks extending between said structural spandrel beams, and pouring a plastic structural material over said rows of blocks, structural material flowing into the spaces between the blocks forming structural ribs.

9. The method of forming a monolithic room-enclosing module as claimed in claim 8 wherein said roof is pitched and said blocks have holes therethrough and are aligned to form channels extending from the eaves of the module toward its peak, and said channels are exposed to the atmosphere at each end thereof after the concrete is poured whereby heated air may pass therethrough by convection.

10. A monolithic room-enclosing module comprising:

a unitary wall-supporting base slab, opposed module walls of dry-stacked rows of abutting low-density blocks on said base slab;

structural posts of higher density material formed adjacent each end of each of said walls of dry-stacked blocks for laterally supporting said dry-stacked blocks, a structural spandrel beam of higher density material formed over each of said module walls of dry-stacked low-density blocks, the weight of said structural spandrel beam acting on said dry-stacked blocks therebelow to maintain said dry-stacked blocks in close compressive relationship with each other for providing each of said module walls with structural stability;

a roof bridging said module walls and supported by said structural posts and said structural spandrel beams; and a skin of cementitious material over at least one face of each of said module walls to provide a continuous surface coating over said at least one face of each of said module walls.

11. The monolithic room-enclosing module as claimed in claim 10 wherein said roof comprises spaced rows of low-density blocks extending between said spandrel beams and a layer of higher density material covering said low-density blocks and filling the spaces between said rows of blocks to encapsulate said blocks.

12. The monolithic room-enclosing module as claimed in claim 11 wherein said roof is pitched so as to have a peak and said low-density blocks in said roof have holes therethrough and are aligned to provide channels extending from the eaves of said roof toward its peak, the ends of said channels being exposed to the atmosphere for air convection through said channels.

13. A monolithic room-enclosing module as claimed in claim 12 further comprising a water shedding cap supported by said roof over the exposed ends of said channels near said peak.

14. A monolithic room-enclosing module as claimed in claim 11 wherein said roof further comprises reinforcing rods embedded in said higher density material.

15. A monolithic room-enclosing module as claimed in claim 10 wherein said cementitious material is stucco.

16. A monolithic room-enclosing module as claimed in claim 10 wherein said higher density material is concrete.

17. A monolithic room-enclosing module as claimed in claim 10 wherein said stacked low-density blocks have a tongue and groove configuration.

18. A unitary prefabricated room-enclosing module including a base portion, at least two opposing sides, and a roof supported by said sides and spanning said base portion:

said at least two opposing sides each including dry-stacked rows of abutting blocks on said base portion, a poured concrete spandrel beam on the top of said dry-stacked blocks, the weight of said spandrel beam compressing said blocks against one another with sufficient force to hold said blocks in tight frictional engagement to provide structural stability, and poured concrete corner posts only at each end of said blocks and joined by said spandrel beams, said corner posts further holding said blocks in position and providing lateral support to said dry-stacked blocks.

19. A unitary prefabricated room-enclosing module as claimed in claim 18 wherein said roof is pitched so as to have a peak and comprised blocks encapsulated in poured concrete, said blocks having holes therethrough and being aligned to provide channels extending from the eaves of the roof toward its peak, the ends of said channels being exposed to the atmosphere for air convection through said channels.

20. The improvement in a monolithic room-enclosing module as claimed in claim 18 wherein rows of said blocks are spaced and the encapsulating material of said roof fills those spaces.

* * * * *

UNITED STATES PATENT AND TRADEMARK OFFICE

CERTIFICATE OF CORRECTION

PATENT NO. : 4,214,408

DATED : July 29, 1980

INVENTOR(S) : FRANK D. RICH, JR.

It is certified that error appears in the above—identified patent and that said Letters Patent is hereby corrected as shown below:

Claim 18, line 14 (column 14, line 8) -

"beams" should read "beam".

Signed and Sealed this

*Fourth* Day of *November 1980*

[SEAL]

*Attest:*

SIDNEY A. DIAMOND

*Attesting Officer*

*Commissioner of Patents and Trademarks*